United States Patent [19]

Lakra

[11] 4,216,754

[45] Aug. 12, 1980

[54] FUEL INJECTION SYSTEM

[75] Inventor: Paul Lakra, Wembley, England

[73] Assignee: Lucas Industries Limited, Birmingham, England

[21] Appl. No.: 961,528

[22] Filed: Nov. 17, 1978

[30] Foreign Application Priority Data

Dec. 9, 1977 [GB] United Kingdom ..... 51265/77

[51] Int. Cl.[3] ..... F02D 5/02

[52] U.S. Cl. ..... 123/447

[58] Field of Search ..... 123/139 AS, 139 E, 139 AT, 123/139 AK, 139 DP

[56] References Cited

U.S. PATENT DOCUMENTS

| | | | |
|---|---|---|---|
| 3,983,855 | 10/1976 | Jarrett | 123/139 AT |
| 4,089,315 | 5/1978 | Lakra | 123/139 AT |
| 4,091,784 | 5/1978 | Seilly et al. | 123/139 AS |

FOREIGN PATENT DOCUMENTS

| | | | |
|---|---|---|---|
| 2423183 | 5/1974 | Fed. Rep. of Germany | 123/139 AT |

*Primary Examiner*—Ira S. Lazarus
*Assistant Examiner*—Magdalen Moy

[57] ABSTRACT

A fuel injection system includes first and second pistons slidable within respective cylinders, the second piston being of larger diameter than the first, first valve means through which fuel at high pressure can be admitted to one end of the second cylinder to act on the piston and second valve means through which fuel can be returned from the one end of the first cylinder to the one end of the second cylinder and a third piston which is subjected to fuel at high pressure for returning the first and second pistons towards the one end of the second cylinder when the first valve means is closed and the second valve means is opened. When the first valve means is opened and the second valve means closed, fuel at injection pressure is displaced from the one end of the first cylinder and is supplied to a fuel injection nozzle for supply to an associated engine.

4 Claims, 1 Drawing Figure

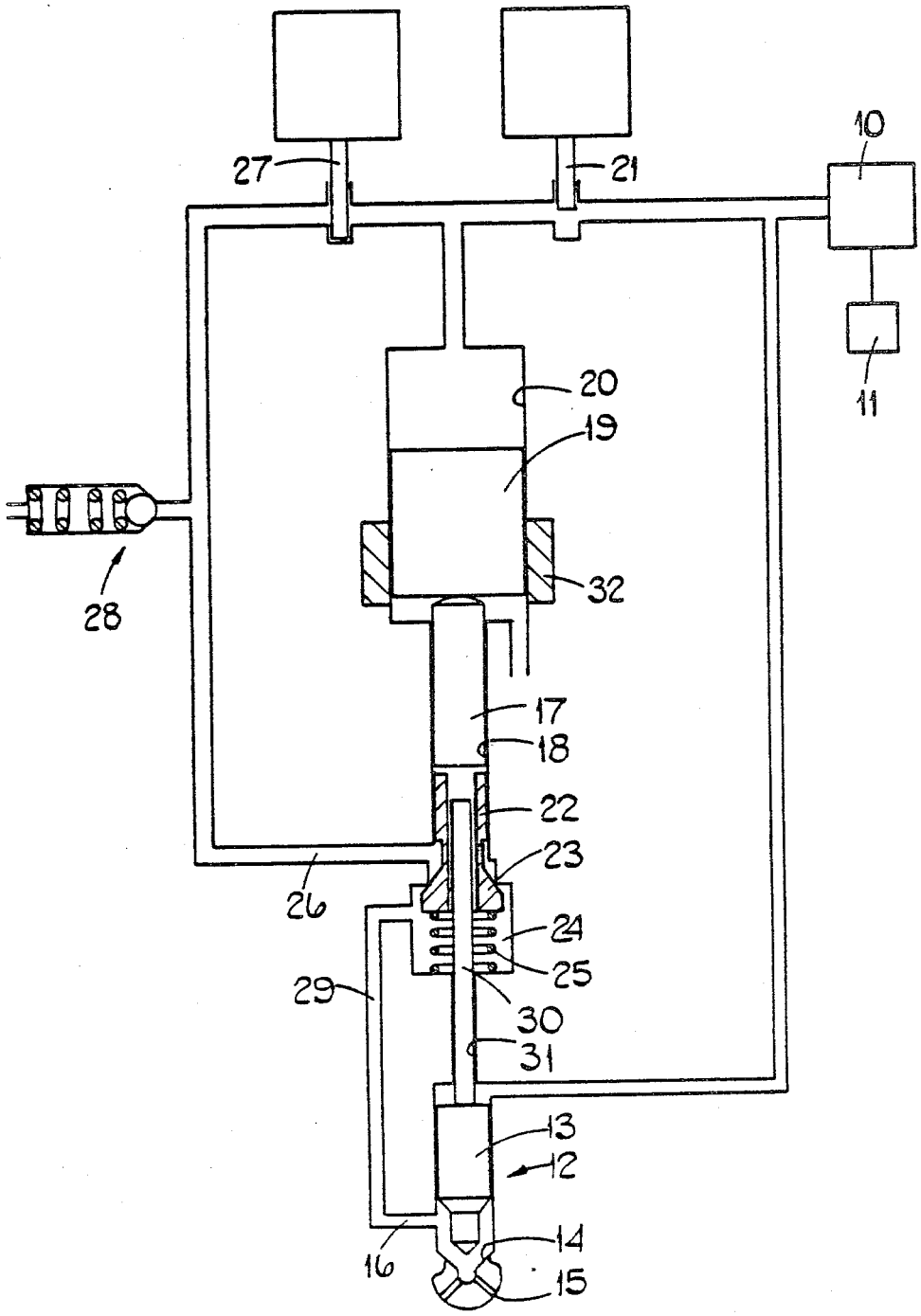
10
27
21
11
20
19
28
32
17
18
22
23
26
24
25
29
30
31
13
12
14
16
15

FUEL INJECTION SYSTEM

This invention relates to a fuel injection system for supplying fuel to an internal combustion engine and of the kind comprising a source of liquid fuel at high pressure, a fuel injection nozzle having an outlet through which in use fuel can flow to a combustion chamber of the associated engine, said injection nozzle including a valve member which can be lifted away from the seating by the action of fuel at injection pressure to permit fuel to flow from an inlet through said outlet, a first piston slidable within a first cylinder, one end of said first cylinder being connected to said inlet, a second piston slidable within a second cylinder, said second piston being of larger diameter than said first piston, first valve means operable to connect said source of fuel with one end of the second cylinder to cause movement of the second piston, movement of the second piston imparting movement to the first piston, said first piston during such movement displacing fuel at injection pressure to said nozzle, a second valve means operable when said first valve means is closed to permit fuel to escape from said one end of the second cylinder and means for returning said pistons towards said one end of the second cylinder.

Such systems are known and in the past it has been the practice to provide a source of fuel at low pressure and to supply fuel from this source to said one end of the first cylinder through a valve. In addition the second valve means when opened has allowed the fuel flowing from the one end of the second cylinder to flow to a drain. The known systems therefore besides requiring an additional source of fuel, also require a large displacement of fuel to achieve injection of a quantity of fuel.

The object of the present invention is to provide such a system in a simple and convenient form.

According to the invention a system of the kind specified comprises a first non-return valve through which fuel flowing from said one end of the second cylinder via said second valve mean, can flow to said one end of the first cylinder, a second non-return valve through which surplus fuel from said one end of the second cylinder can flow to a drain and a third piston which is subjected to the fuel at high pressure, for returning said first and second pistons towards said one end of said second cylinder.

One example of a fuel injection system in accordance with the invention will now be described with reference to the accompanying schematic diagram.

Referring to the drawing there is provided an accumulator 10 in which is stored fuel at high pressure. The fuel is supplied to the accumulator by means of a pump 11.

Also provided is a fuel injection nozzle indicated at 12 and which comprises a valve member 13 slidable within a bore, the valve member being of stepped form and having its larger end constantly subjected to the fuel at high pressure within the accumulator. The valve member is urged by the fuel under pressure so that the reduced end portion of the valve member co-operates with a seating 14 to prevent fuel flow through outlet orifices 15. The injection nozzle is also provided with an inlet 16 for fuel at injection pressure. The pressure of fuel at injection pressure is higher than the fuel pressure within the aforesaid accumulator and this pressure acts on the valve member 13 to lift it from the seating thereby to allow fuel flow through the orifices 15.

There is also provided a first piston 17 slidable within a first cylinder 18. In addition a second piston 19 is provided, this being slidable within a second cylinder 20. The cylinder 18 is formed as an extention of the cylinder 20 and the pistons 19 and 17 are in engagement with each other. One end of the second cylinder 20 communicates with the accumulator 10 by way of a first valve means 21 and the other end of the cylinder 20 is in communication with a drain.

Slidable within the one end of the first cylinder 18 remote from the second cylinder is the valve member 22 of a first non-return valve. The valve member 22 is provided with a head 23 which engages a seating defined by a step formed between an enlarged portion at the end of the cylinder 18 and a chamber 24. The head 23 lies within the chamber 24 and the valve member is biased by a coiled compression spring 25 so that the head contacts the seating. Moreover, the valve member is provided below the head, with a circumferential groove which communicates with a conduit 26 and this conduit communicates with the one end of the cylinder 20 by way of a second valve means 27. Moreover, a second non-return valve 28 is provided which leads from the conduit 26 to a drain.

The aforesaid chamber 24 is in communication with the inlet 16 by way of a connecting passage 29 and extending through the valve member 22 is an axially disposed drilling.

Also provided is a third piston 30 which is slidable within a cylinder 31 extending between the chamber 24 and the cylinder which accommodates the valve member 13 of the nozzle 12. The piston 30 is of smaller diameter than the piston 17 and extends through the chamber 24 and with clearance, through the drilling in the valve member into engagement with the piston 17.

The operation of the system will now be described. As shown in the drawing the valve means 21 is open and the two pistons 17 and 19 are moving in the direction towards the nozzle 12. The fuel at injection pressure which is displaced by the piston 17 flows through the clearance defined between the piston 30 and the wall of the drilling in the valve member 22, into the chamber 24 and via the passage 29 to the inlet 16. The valve member 13 of the nozzle is therefore lifted from its seating and fuel is flowing through the outlet orifices 15. During continued movement of the two pistons, the piston 17 will engage the end of the valve member 22 thereby lifting the head of the valve member away from the seating. When this occurs the pressure of fuel supplied to the inlet 16 of the nozzle falls to a value which is set by the non-return valve 28 and since this is considerably lower than the pressure of fuel within the accumulator, the valve member 13 of the nozzle will close quickly onto its seating. The piston 30 which during delivery of fuel through the orifices 15, is in engagement with the valve member 13, will move when the head 23 is lifted from its seating, into engagement with the piston 17. If desired the piston 30 can be made longer so that during continued movement of the pistons 17 and 19, the piston 30 acts to transmit movement between the piston 17 and the valve member 13.

The next stage in the operation of the system is to close the valve means 21 and open the valve means 27. When this takes place the high pressure of fuel acting on the piston 30 moves the pistons 17 and 19 upwardly as shown in the drawing. Fuel is therefore displaced from the aforesaid one end of the cylinder 20 and flows by way of the second valve means 27 and the conduit 26, to act on the head of the valve member 22 to maintain the head of the valve member away from its seating. This fuel therefore flows into the chamber 24 and through the aforesaid drilling into the cylinder 18. Since the amount of fuel displaced by the piston is greater than that required to displace the piston 17, there will be an excess of fuel and this flows to a drain by way of the non-return valve 28. The pistons are allowed to move in this fashion until the desired quantity of fuel has been supplied to the cylinder 18 for the next injection of fuel to the engine. This quantity is determined by a sensing coil 32 which senses the position of the piston 19. When a signal is given that sufficient fuel has flowed to the cylinder 18, the valve means 27 is closed thereby preventing further movement of the piston 19, and the spring 25 closes the head 23 of the valve member onto its seating. The system is then ready for the next delivery of fuel to the engine which is effected by opening the valve means 21. The valve means 21 and 27 are conveniently electromagnetic valves and are controlled from a control system (not shown) which besides receiving the signal from the coil 32 also receives a timing signal from the engine to ensure that the delivery of fuel occurs at the correct time. In addition the control system receives a demand signal representing the amount of fuel which it is required to supply to the engine. The control system may also be supplied with other signals for example, engine speed, temperature and air pressure to enable it to act as a governor to control the speed of the associated engine.

By the arrangement described it will be appreciated that as compared with the earlier systems there is no need for a special source of low pressure fuel to effect movement of the pistons. Moreover the amount of fuel which is lost to the drain is considerably less than in the earlier systems so that less fuel is pumped resulting in a reduced power consumption.

I claim:

1. A fuel injection system for supplying fuel to an internal combustion engine and of the kind comprising a source of liquid fuel at high pressure, a fuel injection nozzle having an outlet through which in use fuel can flow to a combustion chamber of the associated engine, said injection nozzle including a valve member which can be lifted away from a seating by the action of fuel at injection pressure to permit fuel to flow from an inlet through said outlet, a first piston slidable within a first cylinder, one end of said first cylinder being connected to said inlet, a second piston slidable within a second cylinder, said second piston being of larger diameter than said first piston, first valve means operable to connect said source of fuel with one end of the second cylinder to cause movement of the second piston, movement of the second piston imparting movement to the first piston, said first piston during such movement displacing fuel at injection pressure to said nozzle, a second valve means operable when said first valve means is closed to permit fuel to escape from said one end of the second cylinder, a first non-return valve through which fuel flowing from said one end of the second cylinder via said second valve means, can flow to said one end of the first cylinder, a second non-return valve through which surplus fuel from said one end of the second cylinder can flow to a drain, and a third piston which is subject to the fuel at high pressure for returning said first and second pistons towards said one end of the second cylinder.

2. A system according to claim 1 in which said first non-return valve includes a seating disposed at the one end of the first cylinder and a valve member slidable in said first cylinder, the valve member having a head disposed beyond the one end of the first cylinder and engageable with said seating, a spring biasing the head into contact with the seating, a passage extending through the valve member and through which fuel flows from said one end of the first cylinder to said inlet, and an annular chamber defined about the valve member beneath the head, said chamber communicating with said second non-return valve and with said one end of the second cylinder by way of said second valve means, said valve member being engaged by said first piston to lift the head from the seating to transmit flow of fuel at injection pressure to said inlet.

3. A system according to claim 2, in which said third piston extends through the passage in the valve member of the first non-return valve, said third piston being engageable with said first piston.

4. A system according to claim 3, in which said third piston is engageable with the valve member of the fuel injection nozzle, and acts during continued movement of the first and second pistons after said first non-return valve has been contacted by the first piston to urge the valve member of the nozzle into engagement with its seating.

* * * * *